US005666193A

United States Patent [19]

Rimai et al.

[11] Patent Number: 5,666,193

[45] Date of Patent: Sep. 9, 1997

[54] INTERMEDIATE TRANSFER OF SMALL TONER PARTICLES

[75] Inventors: Donald S. Rimai, Webster; Thomas N. Tombs, Brockport; Bruce R. Benwood, Churchville; David J. Quesnel, Pittsford, all of N.Y.

[73] Assignee: Eastman Kodak Company, Rochester, N.Y.

[21] Appl. No.: 605,340

[22] Filed: Feb. 9, 1996

[51] Int. Cl.[6] ..... G03G 15/16

[52] U.S. Cl. ..... 399/308; 428/147; 430/126; 399/310

[58] Field of Search ..... 355/271–275, 355/326 R, 327; 430/124, 126; 428/143, 147

[56] References Cited

U.S. PATENT DOCUMENTS

| | | | |
|---|---|---|---|
| 4,737,433 | 4/1988 | Rimai et al. | 430/111 |
| 5,084,735 | 1/1992 | Rimai et al. | 355/271 |
| 5,156,915 | 10/1992 | Wilson et al. | 428/425.8 |
| 5,212,032 | 5/1993 | Wilson et al. | 430/65 |
| 5,217,838 | 6/1993 | Wilson et al. | 430/126 |
| 5,250,357 | 10/1993 | Wilson et al. | 428/425.8 |
| 5,370,961 | 12/1994 | Zaretsky et al. | 430/126 |

OTHER PUBLICATIONS

Dessauer & Clark, Xerography and Related Processes, p. 393.

Narendra S. Goel & Paul R. Spencer, Polym. Sci. Technol. Toner Particle–Photoreceptor Adhesion, 1975, 9B, pp. 763–827.

D.S. Rimai, L.P. Demejo, & R.C. Bowen, Fundamentals of Adhesion and Interfaces, VSP 1995, pp. 1–23.

D.S. Rimai, L.P. Demejo, & R.C. Bowen, J. Adhesion Sci. Technol., VSP 1994, vol., 8, No. 11, pp. 1333–1355.

Schaffert, Electrophotography, Floral Press, NY, (1975), pp. 512–519.

Zaretsky, Imaging Sci. Tech., Performance of an Electrically Biased Transfer Roler in a Kodak ColorEdge CD Copier, vol., 37, No. 2, Mar./Apr. 1993.

*Primary Examiner*—Matthew S. Smith
*Attorney, Agent, or Firm*—Nelson A. Blish

[57] ABSTRACT

A small particle toner image is formed on a primary image member (11), such as a photoconductor; electrostatically transferred to an intermediate transfer member (22); and then electrostatically transferred to a receiving sheet. The intermediate transfer member includes a base of a relatively compliant material having an embedded coating of beads with a volume weighted average diameter of less than about 3 microns, and preferably between 0.5 and 1.0 micron. These beads cover at least 40% of the intermediate image member.

24 Claims, 4 Drawing Sheets

1 μm

INTERMEDIATE TRANSFER OF SMALL TONER PARTICLES

BACKGROUND OF THE INVENTION

1. Field of the Invention

This invention relates to the transfer of electrostatically formed toner images using an intermediate transfer member. In particular, it relates to creation of multi-color toner images with small particle toners.

2. Description of the Prior Art

The use of an intermediate transfer member is useful in electrophotography for a number of reasons, including simplified receiving sheet handling, single pass duplexing, saving wear on photoconductors and superposition of images to form multi-color images. Typically, a toner image is created on a photoconductive member electrophotographically, and is then transferred to an intermediate transfer member, such as a roller or web. For example, a negatively charged toner image is transferred from a photoconductor having an electrically grounded backing electrode, to an intermediate web or roller biased to a strong positive polarity. The toner image is then transferred from the intermediate member to a receiving sheet under the influence of a second electric field. The second electric field can be created, without changing the voltage on the intermediate member, by placing a roller or corona behind the receiving sheet, which is biased in a stronger, positive direction.

The most desirable use of intermediate transfer is for creating multi-color images. When an intermediate transfer member is used, two, three, four or more separate images of different color can be transferred in registration to the intermediate transfer member to create a multi-color image. The multi-color image can then be transferred in one step to the receiving sheet. This system has a number of advantages over the more conventional approach to making multi-color images in which the receiver sheet is secured to the periphery of a roller and rotated repeatedly into transfer relation with the photoconductor to receive the color images directly. The most important advantage is that the receiving sheet itself does not have to be attached to a roller. Attaching the receiving sheet to a roller has been a source of misregistration of images due to independently transferring each color image to the receiver, as well as complexity in apparatus. Other advantages, such as wear and tear on the photoconductive member and a straight and simple receiving sheet path are also important.

High resolution in electrophotographic color printing is desirable. In order to obtain higher resolution, fine toners are necessary. Toners less than 20 microns, and especially toners less than 10 microns in size, give substantially improved resolution in color imaging with high quality equipment. Unfortunately, fine toners are more difficult to transfer electrostatically than are traditional coarse toners. This is a problem using both single transfer and intermediate transfer members.

Rimai and Chowdry have shown that by avoiding air gaps between toner and receiver, the surface forces can be at least partially balanced, thereby permitting images made using small toner particles to be transferred using high efficiency. See Rimai and Chowdry, U.S. Pat. No. 4,737,433. See, also, Dessauer and Clark, *Xerography and Related Processes*, page 393, Focal Press (New York), N. S. Goel and P. R. Spencer, *Polym. Sci. Technol.* 9B, pp. 763–827 (1975).

When transferring toners having a volume weighted average diameter less than 12 microns, and using electrostatics at both transfers, a number of transfer artifacts occur. For example, a well known artifact called "hollow character" is a result of insufficient transfer in the middle of high density toned areas, e.g., in alphanumerics. Another artifact, "halo" is experienced when toner fails to transfer next to a dense portion of an image. Use of materials suggested in the prior art tends to produce these artifacts when using two electrostatic transfer steps. These problems cannot be eliminated merely by an increase of the transfer field, since that expedient is limited by electrical breakdown.

One attempt to solve this problem is disclosed in Rimai et al, U.S. Pat. No. 5,084,735. This patent discloses use of an intermediate transfer member with a compliant intermediate blanket overcoated with a thin skin which has a higher Young's modulus than the underlying blanket. The blanket gives compliance whereas the skin controls adhesion. The outer skin has Young's modulus greater than of $5\times10^7$ Pa. A problem encountered when using a thin outer skin on the intermediate transfer member, is that it cracks and delaminates. Moreover the skin tends to reduce the compliance of the intermediate.

SUMMARY OF THE INVENTION

It is the object of the invention to provide a method and apparatus for transferring toner images electrostatically from a first image member to an intermediate transfer member, and then electrostatically from the intermediate transfer member to a receiving sheet, with a minimum of image defects and a maximum of toner transferred. It is also an object of the invention to provide an intermediate transfer member capable of transferring toner particles having volume weighted diameters less 9 microns. An additional object of the invention is to provide an intermediate transfer member not susceptible to cracking and delaminating.

The above and other objects are accomplished by forming a toner image on a receiving sheet in which an electrostatic image is first formed on a primary image member, the electrostatic image is toned with a dry toner to form a toner image, and the toner image is transferred from the primary image member in the presence of an electric field urging toner particles from the primary image member to the intermediate transfer member. The toner image is then transferred from the intermediate transfer member to a receiving sheet in the presence of an electric field urging the toner particles from the intermediate transfer member to the receiving sheet.

The invention is characterized by an intermediate transfer member, comprised of an elastomeric blanket, coated on the surface of the blanket, with relatively hard, small beads. The volume weighted diameter of said beads are between 0.05 micron and 3.0 microns and preferably between 0.2 micron and 1.0 micron. The beads have a Young's modulus greater than 0.1 Giga Pascal (GPa.) and preferably greater than 2 GPa, and cover at least 40% of the surface of the elastomeric blanket, and preferably should completely cover the entire surface.

DETAILED DESCRIPTION OF THE PREFERRED EMBODIMENT

Figure 1:
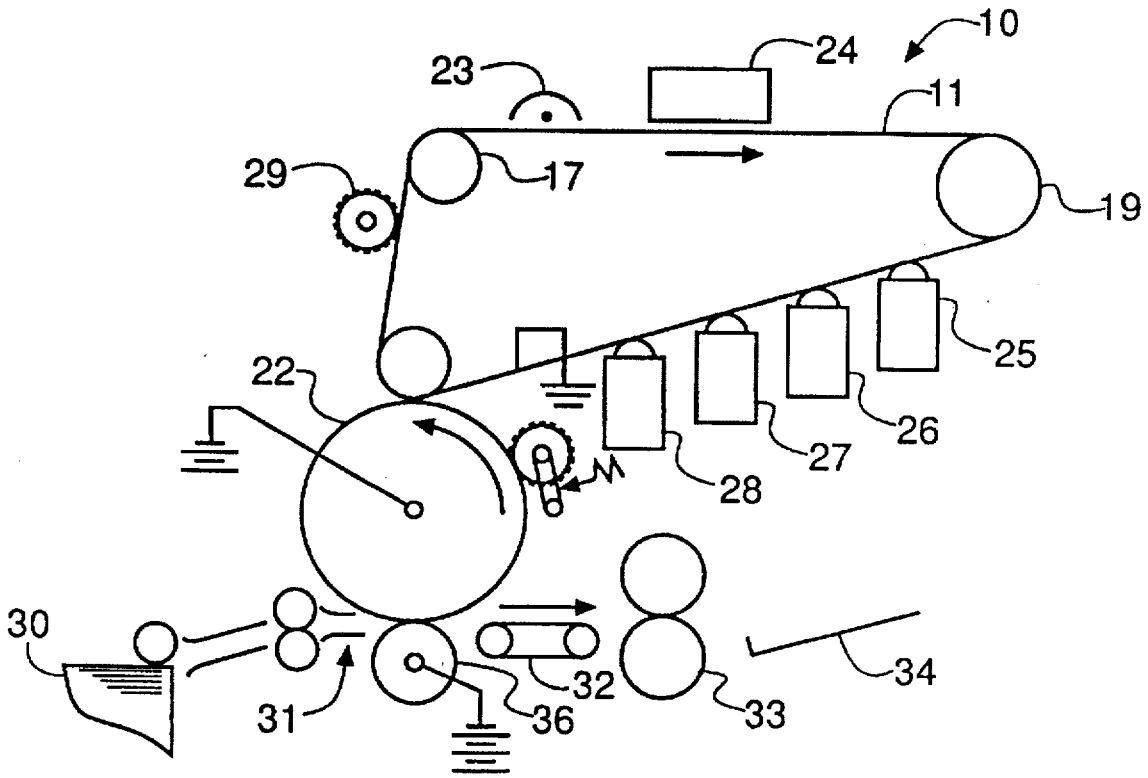
FIG. 1 is a schematic side view of a color printer apparatus utilizing the invention.

FIG. 1 illustrates an apparatus 10 in which the invention is intended to be used. A primary image member 11, for example, a photoconductive web is trained about rollers 17, 18, and 19, one of which is drivable to move primary image member 11 past a series of stations well known in the electrophotographic art. Primary image member 11 is uniformly charged at a charging station 23, imagewise exposed at an exposure station 24 by means of, for example, an LED print head or laser electronic exposure station, to create an electrostatic latent image. The latent image is toned by one of toner stations 25, 26, 27, or 28 to create a toner image corresponding to the color of toner in the station used. The toner image is transferred from primary image member 11 to an intermediate transfer member, for example, an intermediate transfer roller 22, at a transfer station formed with roller 18. Primary image member 11 is cleaned at a cleaning station 29 and reused to form more toner images of different colors, utilizing toner stations 25, 26, 27, and 28. One or more additional images are transferred in registration with the first image transferred to roller 22 to create a multi-color toner image on the surface of transfer roller 22.

The multi-color image is transferred to a receiving sheet which has been fed from supply 30 into transfer relationship with transfer roller 22 at transfer station 31. The receiving sheet is transported from transfer station 31 by a transport mechanism 32 to a fuser 33 where the toner image is fixed by conventional means. The receiving sheet is then conveyed from the fuser 33 to an output tray 34.

The toner images are transferred from the primary image member 11 to the intermediate transfer roller 22 in response to an electric field applied between the core of roller 22 and a conductive electrode forming a part of primary image member 11. The multi-color toner image is transferred to the receiving sheet at transfer station 31 in response to an electric field created between a backing roller 36 and transfer roller 22. Thus, transfer roller 22 helps establish both electric fields. As is known in the art, a polyurethane roller containing an appropriate amount of anti-static material to make it of at least intermediate conductivity can be used for establishing both fields. Typically, the electrode buried in primary image member 11 is grounded for convenience in cooperating with the other stations in forming the electrostatic and toner images. If the toner is a positively-charged toner, an electrical bias applied to intermediate transfer roller 22 of typically −200 to −1500 volts will effect substantial transfer of toner images to transfer drum 22. To transfer the toner image onto a receiving sheet at transfer station 31, a bias of about −3000 volts, is applied to backing roller 36 to again urge the positively charged toner to transfer to the receiving sheet. Schemes are also known in the art for changing the bias on drum 22 between the two transfer locations so that roller 36 need not be at such a high potential.

Unfortunately, using small toners, with a polyurethane roller and transferring the toners directly to the polyurethane surface and then to the receiving sheet, transfer artifacts are produced on the receiving sheet. This is due to insufficient transfer under the urging of the electrostatic fields at one of the two transfer stations. These artifacts appear to be due to the electrostatic field in a given area being unable to overcome non-electrostatic forces between the toner and the surfaces involved. Increasing the electric field to compensate for these problems risks electrical breakdown.

Figure 2:
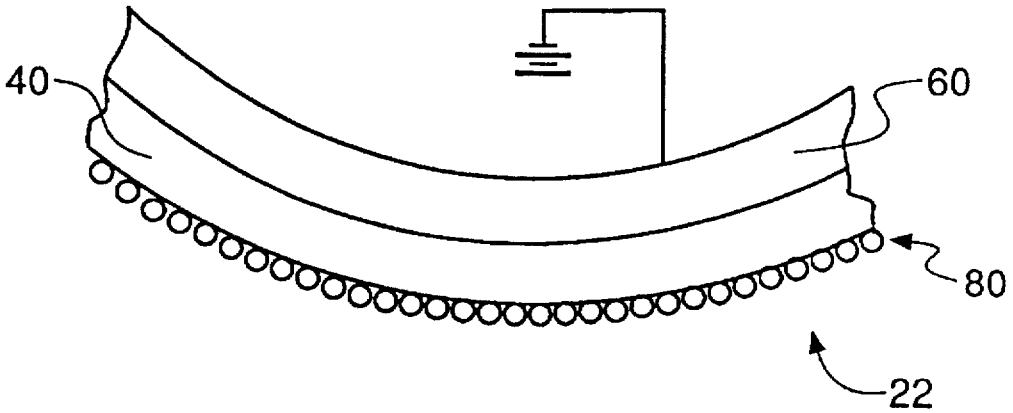
FIG. 2 is a cross-section of a portion of an intermediate transfer roller or drum constructed according to the invention.

A partial cross-section of a preferred embodiment of a transfer intermediate member is shown in FIG. 2 in which a roller or drum 22 has a polyurethane base 40, sometimes referred to as an elastomeric blanket. The polyurethane blanket has a conducting layer 60 having a thickness of between 0.05 and 3.0 centimeters. The elastomeric blanket must be sufficiently compliant so as to allow it to conform to the irregularities encountered in electrostatic toner transfer without being so compliant so as to become too adhesive. This is accomplished by requiring that the Young's modulus of the blanket material be between 0.5 MPa. and 10 MPa. Preferably, the Young's modulus of the blanket should lie between 1.0 MPa. and 5 MPa. The blanket should have an electrical resistivity between about $10^6$ ohm-cm and about $10^{12}$ ohm-cm and preferably between $10^8$ and $10^{10}$ ohm-cm The blanket is supported in this example by an electrically conducting rigid material 60, such as aluminum.

Figure 3:
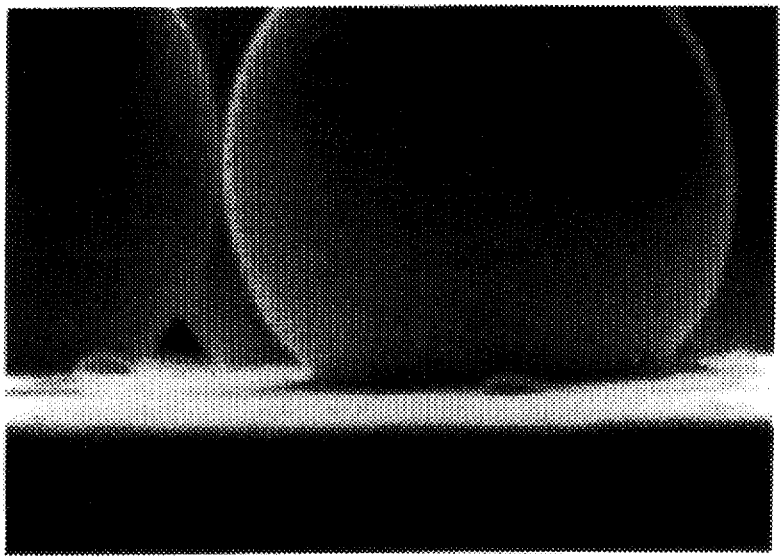
FIG. 3 is an electronmicrograph of beads on the surface of an intermediate transfer member.

The surface of the elastomeric blanket 40 is coated with a fairly uniform coating of small, relatively rigid beads or particles, having a Young's modulus greater than about 0.1 GPa. Generally, surface forces between the beads and blanket will cause the blanket to deform in the manner described by Rimai et al in *Fundamentals of Adhesion and Interfaces*, VSP, Utrect(1995), pp. 1–23. It is important that the coating of beads on the surface of the elastomeric blanket be sufficiently dense so as to effectively preclude the toner particles from directly contacting the elastomeric blanket. This can be accomplished by mechanically coating the surface, with a sufficient number of the beads so that at least about 40% of the surface on average is coated in a fairly uniform manner. The compliant surface of the elastomeric blanket holds the beads on the blanket by surface tension, and beads are partially imbedded in the surface of the blanket as shown in FIG. 3. The beads can also be attached to the elastomeric blanket by other means including chemical bonding, sintering, or using an adhesive layer between the beads and the elastomeric blanket.

The coating beads can be deposited onto the elastomeric blanket in any suitable manner. These include aerosol deposition, application by hand or mechanical means, electrostatic attraction and attachment, and coating from a suspension.

The actual shape of the beads is not critical, and cubic, hexagonal, or flat particles arranged in a tile-like array are suitable. Preferably, the beads are spherical or spheroidal and arranged on the surface of the elastomeric blanket in a hexagonally-packed array so that at least 60% of the surface is covered.

The size of the beads is governed by two concerns: (1) the beads should be sufficiently small compared to the size of the toner particles so that the toner particles cannot lodge between the coating beads, thereby making the toner particles more difficult to transfer to the receiver, and (2) the beads should embed sufficiently into the elastomer so that they cannot be readily dislodged during transfer and cleaning, without embedding so deeply that they are below the surface of the underlying blanket. The criteria for such embedding is discussed in the paper by Rimai, DeMejo and Bowen, *Journal of Adhesion Science and Technology*, Vol. 8, p. 1333(1994). Both of the above criteria are met for elastomeric materials by beads having a particle size between about 0.05 micron and about 3.0 microns. The preferred range in bead size is between 0.2 microns and 1.0 microns. In order to control the adhesion characteristics of the intermediate transfer member, the Young's modulus of the beads must be greater than about 0.1 GPa., and preferably greater than 2.0 GPa. Suitable beads for coating the intermediate transfer member include but are not limited to, polystyrene beads, polyvinylidene fluoride, lattices, fused silica, strontium titanate.

In order to optimize electrostatic toner transfer, it is desirable to maximize the electrostatic field during the transfer process without generating defects by exceeding the Paschen limit of air. (The Paschen limit is the electric field strength at which the air breakdown in a gas starts, and is measured in volts per meter. See Schaffert, *Electrophotography*, Foral Press, New York (1975), (pp 514–519)). This is accomplished using a semi-conducting elastomeric blanket material in a manner analogous to the electrostatic transfer roller described by Zaretsky. See *Imaging Sci. Tech.*, 37,187 (1993). The specific optimal resistivity of the elastomeric blanket material is determined by parameters including, but not limited to, process speed, transfer nip width, and blanket thickness. The specific biasing scheme depends on optimizing the transfer field while minimizing the effects due to ionization which occur if the Paschen limit is exceeded. This can be accomplished in a manner analogous to that described by Zaretsky for a transfer roller. Similar biasing schemes can be used to effect transfer from the photoconductive element to the intermediate transfer member.

While this invention is suitable for use with toner particles greater than 1 micron in diameter, it is preferred to use this technology to electrostatically transfer images made with toner particles having mean volume weighted diameters between about 1 and 10 microns, and more preferably between 3 microns and 8 microns.

The intermediate transfer member structure described in this disclosure is suitable for use as an intermediate roller or drum. However, it is possible to use an intermediate web or belt as the intermediate transfer member, which can be made to traverse an irregular path. For use as a web, the intermediate transfer member can consist simply of an elastomeric blanket material with the properties described above, except for the conducting layer. The web is coated with the beads as above. In this embodiment, the transfer bias can be applied using techniques such as incorporating electrically biased, conducting back-up rollers in the transfer nips.

Figure 4:
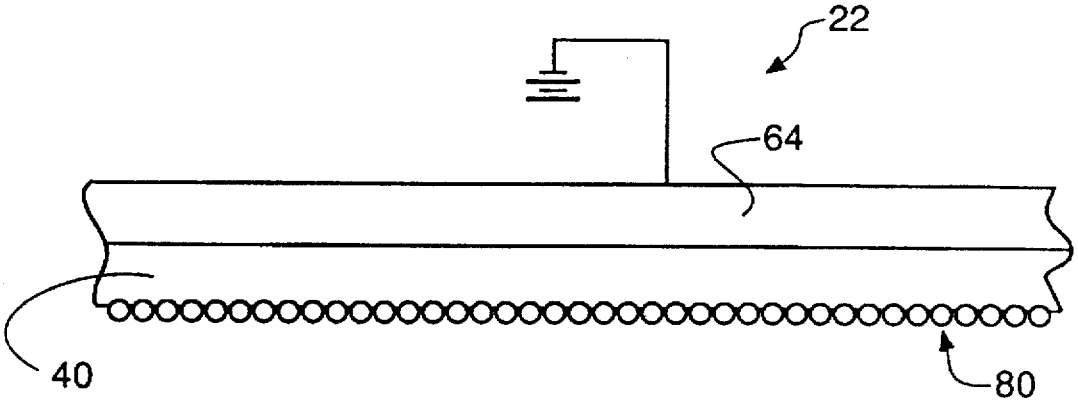
FIG. 4 is a cross-section of a portion of an intermediate transfer roller according to an alternate embodiment of the invention.

It is preferred, however, to incorporate backing member 64, shown in FIG. 4, adjacent to the elastomeric blanket 40. This backing member consists of a flexible material having a Young's modulus greater than 1 GPa and serves as a support for the elastomeric blanket. This material should be sufficiently conductive so as to allow the intermediate to be electrically biased. Suitable backing member materials include nickel and stainless steel, which can be made sufficiently thin so as to allow them to flex around any rollers and angles encountered in the path of the web. Alternatively, polymers or other flexible materials having said Young's modulus and flexibility are also suitable. If the support material is not electrically conducting, it should be coated with an electrically conductive layer such as evaporated nickel on the side of the support contacting the elastomeric blanket. It is preferable, however, to use a seimiconducting support, such as a polymeric material having a sufficiently high Young's modulus, doped with a charge transport material such as those described in U.S. Pat. Nos. 5,212,032, 5,156,915, 5,217,838, and 5,250,357. This would allow the voltage applied to the web to be varied spatially.

Two transfer intermediate rollers were made according to this invention. The rollers consisted of polyurethane having a conductivity of about $2.3\times10^7$ ohm-cm, and having Young's modulus of approximately 4 MPa. In each case half the roller was coated by hand with submicrometer diameter beads while the other half was left uncoated. Neutral density step tablets were placed on the exposure station so that areas of equal density would develop on portions of the photoconductor corresponding to both the coated and uncoated portions of the transfer intermediate roller. After transferring the developed image to the transfer intermediate roller, the bias on the roller was reversed and the image was transferred to Kromekote paper, produced by Champion, Inc. The density of the various steps was then measured using an X-Rite transmission densitometer. This provided measurement of the amount of toner on the paper. Since the images were both made at the same time, on the same piece of photoconductor, using the same developer, in the same station, variations in final image density can be attributed to variations in the transfer efficiency. The developer used in these experiments comprised a cyan toner, having a volume weighted average diameter of 5 micron, using the evaporated limited coalescence method, with a 30 micron volume average diameter ferrite carrier. This process is disclosed in U.S. Pat. No. 5,370,961.

EXAMPLE 1.

Figure 5:
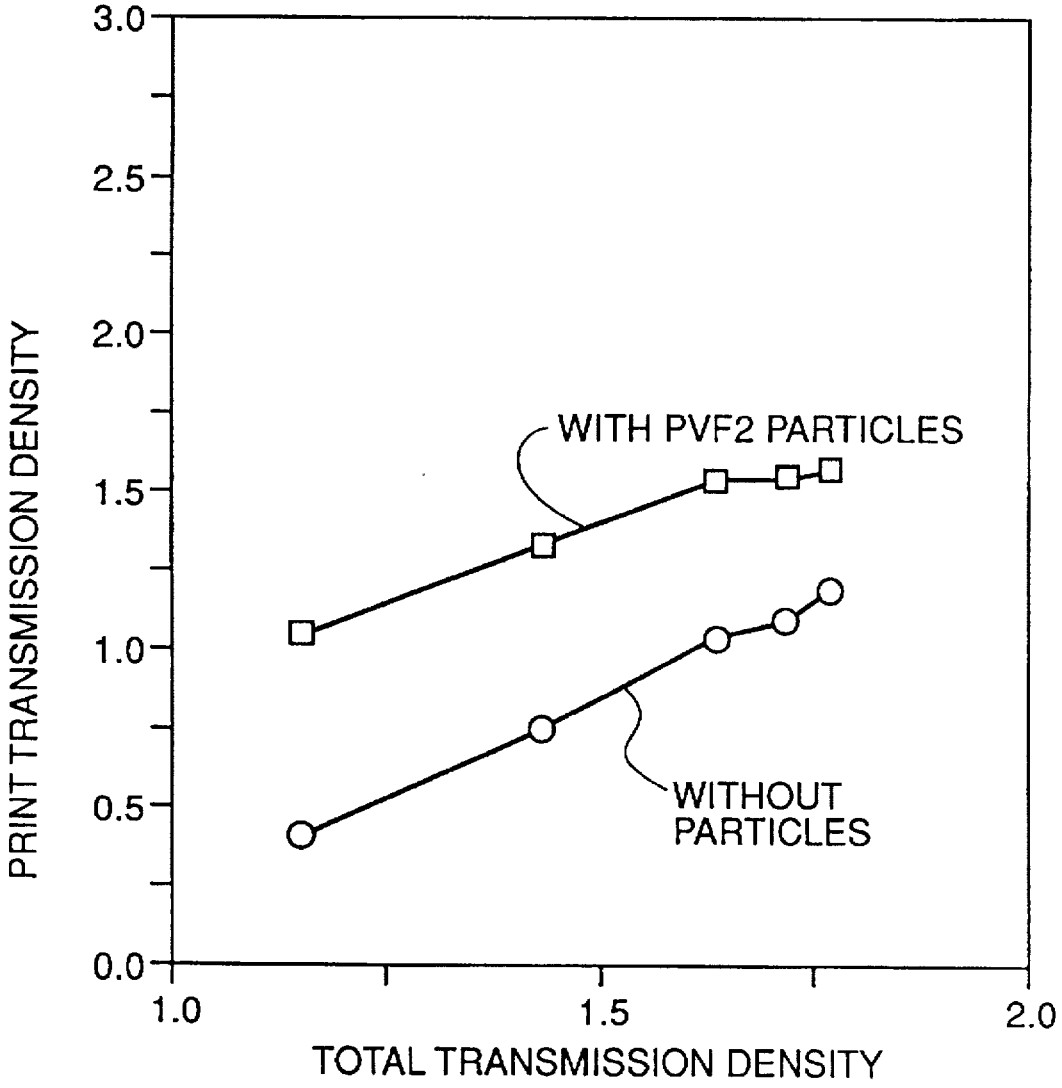
FIG. 5 is a graph of transmission density versus receiver density, with polyvinylidene fluoride beads and without beads.

Beads of polyvinylidene fluoride $PVF_2$ sold under the name Kynar 301F, produced by Pennwalt, were rubbed by hand onto one half of an intermediate transfer roller, coating the roller with as much material as possible. The particles had diameters of approximately 0.3 microns and a Young's modulus of approximately 1 GPa. The voltages applied to the intermediate transfer roller used to transfer the image from the photoconductor to the roller and from the roller to the paper were, respectively, −600 volts and +800 volts. As can be seen from the graph in FIG. 5, the transfer efficiency from the portion of the intermediate transfer roller coated with the Kynar 301F showed much better transfer efficiency. In addition the beads did not appear to come off the intermediate during transfer or subsequent cleaning.

EXAMPLE 2.

Figure 6:
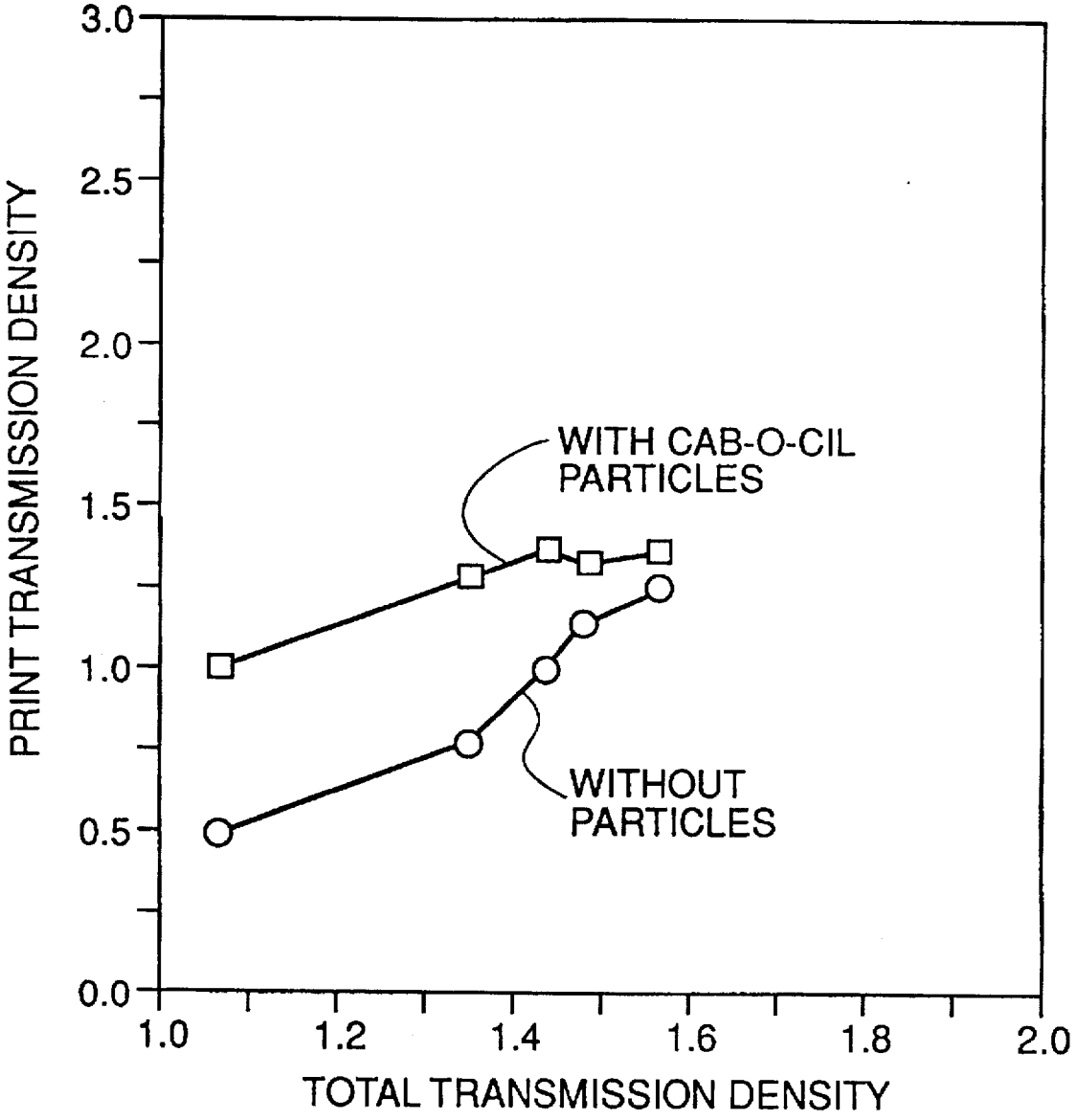
FIG. 6 is a graph of transmission density versus receiver density, with silica beads and without silica beads.

This example is similar to example 1 except that beads of silica, sold as Cab-O-Cil, produced by Cabot, were used instead of the Kynar 301F. These beads have a Young's modulus in excess of 10 GPa and have diameters of approximately 0.3 microns. Transfer voltages were −200 volts and +800 volts. As can be seen from the graph in FIG. 6, the portion of the intermediate transfer roller coated with the beads had much higher transfer efficiencies.

This invention has been described in detail with particular reference to preferred embodiment thereof, but it will be understood that variations and modifications can be effected within the spirit and scope of the invention as set forth in the claims.

PARTS LIST

| | |
|---|---|
| 10. Apparatus | 50. |
| 11. Primary Image member or Photoconductive web | 51. |
| 12. | 52. |
| 13. | 53. |
| 14. | 54. |
| 15. | 55. |
| 16. | 56. |
| 17. Roller | 57. |
| 18. Roller | 58. |
| 19. Roller | 59. |
| 20. | 60. Aluminum core |
| 21. | 61. |
| 22. Transfer roller drum | 62. |
| 23. Charging station | 63. |
| 24. Exposure station | 64. Backing member |
| 25. Toner station | 65. |
| 26. Toner station | 66. |
| 27. Toner station | 67. |
| 28. Toner station | 68. |
| 29. Cleaning station | 69. |
| 30. Supply | 70. |
| 31. Transfer station | 71. |
| 32. Transport mech. | 72. |
| 33. Fuser | 73. |
| 34. Output tray | 74. |
| 35. | 75. |
| 36. Backing roller | 76. |
| 37. | 77. |
| 38. | 78. |
| 39. | 79. |
| 40. Elastomeric blanket or Polyurethane base | 80. Beads |

We claim:

1. A method of forming a toner image on a receiving sheet, said method comprising:

forming an electrostatic latent image on a primary image member;

toning said latent image with a dry toner to form a toner image by applying a dry toner having a volume weighted diameter between about 1 and 10 microns to said electrostatic image;

transferring said toner image from said primary image member to an intermediate transfer member in the presence of an electric field urging toner particles from said primary image member to said intermediate transfer member, said intermediate transfer member being coated with beads having volume weighted diameters less than about 3 microns; and transferring said toner image from said intermediate transfer member to a receiving sheet in the presence of an electric field urging toner particles from said intermediate transfer member to said receiving sheet.

2. The method according to claim 1 wherein said toner particles have a volume weighted diameter between 3.0 and 8.0 microns.

3. The method according to claim 1 wherein the said beads have a Young's modulus greater than about 0.1 GPa.

4. The method according to claim 1 wherein the said beads have a Young's modulus greater than 2.0 GPa.

5. A method according to claim 1 wherein said beads have a volume weighted diameter between 0.05 microns and 3 microns.

6. A method according to claim 1 wherein said beads have a volume weighted diameter between 0.2 microns and 1.0 microns.

7. A method according to claim 1 wherein at least about 40% of the surface of said intermediate transfer member is coated with said beads.

8. A method according to claim 1 wherein said beads cover 60% of said intermediate transfer member.

9. The method according to claim 1 wherein said beads are spheroidal.

10. The method according to claim 1 wherein the intermediate transfer member comprises an elastomer material having a Young's modulus of between 0.5 MPa and 10 MPa.

11. The method according to claim 1 wherein said immediate transfer member has a compliant layer between 0.05 and 3 cm thick.

12. The method according to claim 1 wherein said intermediate transfer member comprises an elastomer having a resistivity between $10^6$ ohm-cm and $10^{12}$ ohm-cm.

13. The method according to claim 1 wherein said intermediate transfer member comprises an elastomer having a resistivity between $10^8$ ohm-cm and $10^{10}$ ohm-cm.

14. The method according to claim 1 wherein said intermediate transfer member is covered with a polyurethane layer.

15. The method according to claim 1 wherein said intermediate transfer member is a web.

16. The method according to claim 1 wherein said intermediate transfer member is a roller.

17. The method according to claim 1 wherein said beads are polystyrene beads.

18. The method according to claim 1 wherein said beads are lattices.

19. The method according to claim 1 wherein said beads are fused silica.

20. The method according to claim 1 wherein said beads are strontium titanate.

21. The method according to claim 1 wherein said beads are polyvinylidene fluoride.

22. A method of forming a multicolor toner image on a receiving sheet, said method comprising:

forming a series of electrostatic images on a primary image member;

toning said images with different color dry toner particles to form a series of different color toner images;

transferring said different color toner images from said primary image member to an intermediate transfer member, in the presence of an electric field urging toner particles from said primary image member to said intermediate transfer member, in registration, to form a multicolor image on the intermediate transfer member; and transferring said multicolor toner image from said intermediate transfer member to a receiving sheet, in the presence of an electric field urging toner particles from said intermediate transfer member to said receiving sheet; and characterized in that the intermediate transfer member is coated with beads having a volume weighted diameter less than 3 microns and a Young's modulus of greater than 0.1 GPa.

23. An intermediate transfer member for transferring a toner image from a primary image member in an electrophotographic apparatus, to a receiving sheet, comprising:

an elastomeric blanket; and beads on said elastomeric blanket having a volume weighted average diameter of about 0.05 microns to 3.0 microns.

24. An intermediate transfer member as in claim 23 wherein said beads have a volume weighted average 0.2 microns to 1.0 microns.

* * * * *